US005275532A

United States Patent [19]

Mazeaud et al.

[11] Patent Number: 5,275,532

[45] Date of Patent: Jan. 4, 1994

[54] AXIAL COMPRESSOR AND METHOD OF CARRYING OUT MAINTENANCE ON THE AXIAL COMPRESSOR

[75] Inventors: Georges Mazeaud, Yerres; Jean L. Picard, Vaux Le Penil, both of France

[73] Assignee: Societe Nationale D'Etude Et De Construction De Moteurs D'Aviation "S.N.E.C.M.A.", Paris, France

[21] Appl. No.: 964,074

[22] Filed: Oct. 21, 1992

[30] Foreign Application Priority Data

Oct. 23, 1991 [FR] France ..... 91 13073

[51] Int. Cl.[5] ..... F04D 29/64; F01D 25/00

[52] U.S. Cl. ..... 415/182.1; 415/199.5

[58] Field of Search ..... 415/182.1, 199.4, 199.5; 29/889.1

[56] References Cited

U.S. PATENT DOCUMENTS

| | | | |
|---|---|---|---|
| 2,711,631 | 6/1955 | Willgoos | 415/199.5 |
| 3,619,086 | 11/1971 | Johnson et al. | 417/360 |
| 3,978,664 | 9/1976 | Parker et al. . | |
| 4,431,373 | 2/1984 | Monsarrat | 415/199.5 |
| 4,715,778 | 12/1987 | Katayama et al. | 415/199.1 |
| 5,127,797 | 7/1992 | Carman | 415/209.2 |

FOREIGN PATENT DOCUMENTS

| | | |
|---|---|---|
| 2317480 | 2/1977 | France . |
| 1488766 | 10/1977 | United Kingdom . |

*Primary Examiner*—Edward K. Look
*Assistant Examiner*—Michael Lee
*Attorney, Agent, or Firm*—Oblon, Spivak, McClelland, Maier & Neustadt

[57] ABSTRACT

A maintenance-friendly axial compressor includes an outer casing formed by half-shells, an inner casing formed by a plurality of annular members carrying sectors of fixed guide vanes defining the stator stages of the compressor, and an annular housing disposed downstream from the inner casing in the region of the diffuser and capable of receiving the annular member corresponding to the downstream stage of the stator when the member is dismounted from the inner casing. Maintenance is carried out by removing the outer casing and dismounting, stage by stage from the downstream end towards the upstream end of the compressor, the annular members of the inner casing and the fixed guide vanes of the stator, the downstream annular member being pushed back into the annular housing and each subsequently dismounted annular member being temporarily secured to the previously demounted annular member as the maintenance progresses.

3 Claims, 3 Drawing Sheets

30
7
17
12
130

AXIAL COMPRESSOR AND METHOD OF CARRYING OUT MAINTENANCE ON THE AXIAL COMPRESSOR

BACKGROUND OF THE INVENTION

1. Field of the Invention

The present invention relates generally to an axial flow turbomachine designed so as to facilitate maintenance thereof, and more particularly to the construction of a maintenance-friendly axial compressor which may include variable guide vanes at an upstream end thereof.

2. Description of the Prior Art

Modern turbojet engines are generally of the twin spool type, that is to say they comprise two compressors, namely a low pressure compressor and a high pressure compressor, driven at different speeds by two turbines.

The last (i.e. downstream) stages of the high pressure (HP) compressor are subjected to high temperatures and to substantial wear. It is therefore desirable to provide easy access for inspection and maintenance of the fixed and movable blades of the last stages of the HP compressor.

However, in order to obtain better performance from the HP compressor, the clearances between rotor and stator are minimized by means such as variable guide vanes in the region of the first stages of the compressor, or by using a monobloc axisymmetrical casing. When these two means are used, maintenance of the downstream stages of the HP compressor becomes very difficult, since the monobloc axisymmetrical casing necessitates dismantling to be carried out from the upstream end, and the variable guide vanes situated at the upstream end must be taken down to gain access to the stages further downstream.

It is known, such as from French patent 2317480 and British patent 1488766, to design turbomachines with access openings passing through the casing or annular envelope surrounding a set of blades to permit maintenance of the blades. The drawback of such arrangements is that they provide access to only a restricted part of the turbomachine.

It is also known to construct compressor casings from half-shells, as well to form guide vane supports from annular members.

SUMMARY OF THE INVENTION

The object of the present invention is to provide a compressor construction which facilitates maintenance of the downstream stages of the compressor, particularly when the compressor includes variable guide vanes at its upstream end, by enabling dismounting and maintenance to be carried out from the downstream end of the compressor without dismantling the upstream stages.

To this end, according to the invention there is provided a maintenance-friendly axial compressor comprising a rotor and a stator, two half-shells defining an outer casing, a plurality of annular members defining an inner casing within said outer casing, at least some of said annular members each carrying sectors of fixed guide vanes to define stages of said stator, a plurality of movable blades carried by said rotor to define rotor stages alternating with said stator stages, and an annular housing downstream from said inner casing, said annular housing being capable of receiving said annular member corresponding to the downstream stage of said stator.

Further according to the invention there is provided a method of servicing such a compressor involving working from the downstream end of said compressor and comprising the following steps:

a) removing said half shells forming said outer casing;

b) dismounting said annular member corresponding to said downstream stage of said stator;

c) pushing back said dismounted annular member into said annular casing;

d) removing said sectors of fixed guide vanes forming said downstream stage of said stator;

e) inspecting and, as necessary, repairing or replacing said removed sectors of fixed guide vanes and said movable blades of the downstream stage of said rotor;

f) dismounting the next annular member in the upstream direction and temporarily securing it to the previously dismounted annular member;

g) removing said sectors of fixed guide vanes forming the next stage of said stator;

h) inspecting and, as necessary, repairing or replacing said removed sectors of fixed guide vanes of said next stator stage and said movable blades of the next rotor stage; and i) successively repeating steps (f) to (h) until access to the desired stage of said compressor is obtained.

The invention may be better understood from the following description of a preferred embodiment, given by way of example, with reference to the attached drawings.

DESCRIPTION OF THE PREFERRED EMBODIMENT

Figure 1:
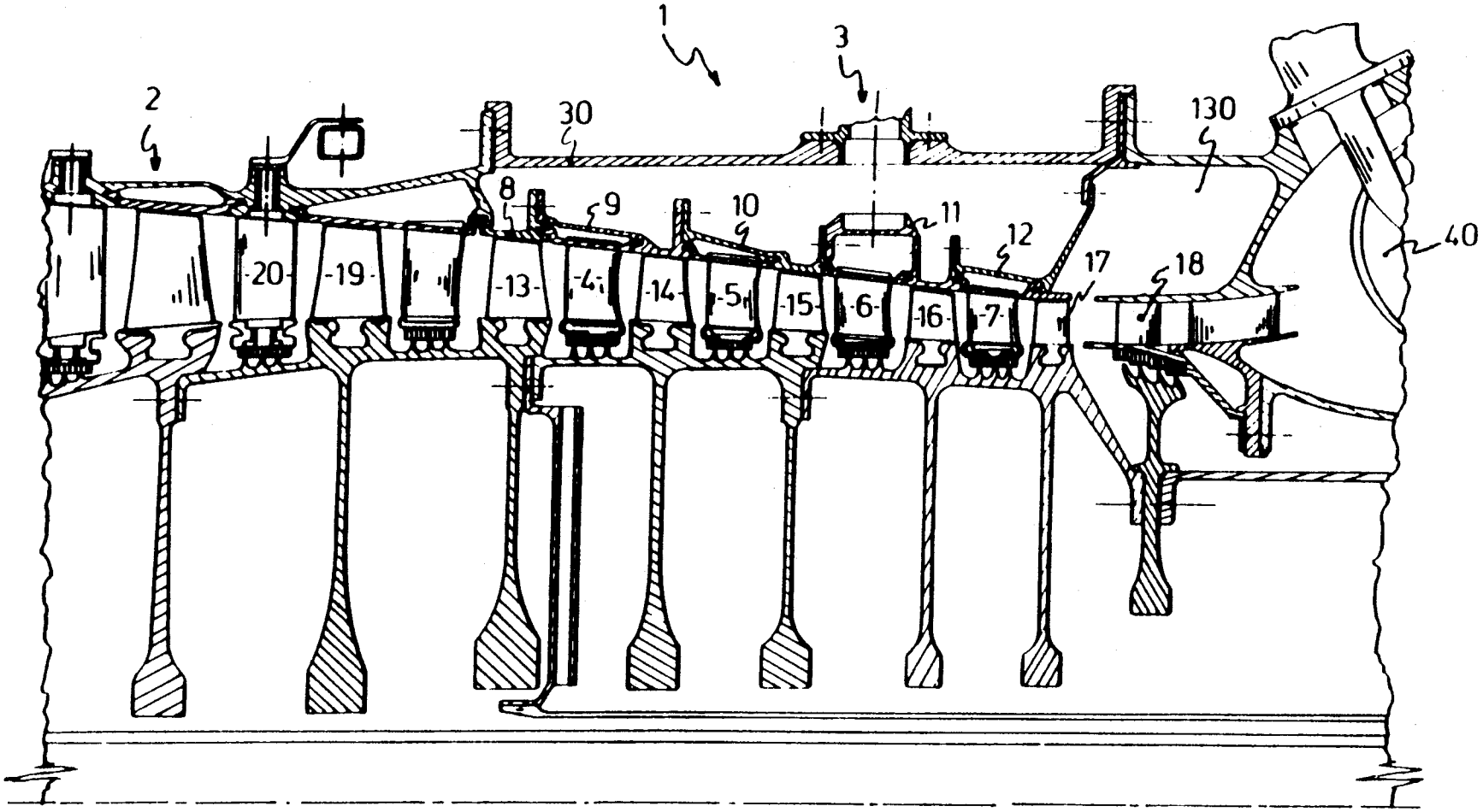
FIG. 1 is a diagrammatic, half-axial sectional view through one embodiment of a high pressure compressor constructed in accordance with the invention.

The HP compressor 1 shown in the drawings has an outer casing consisting of an upstream part 2 surrounding a plurality of variable guide vane stages 20 of the stator and a plurality of corresponding rotor blade stages 19, and a downstream part 3 surrounding a plurality of sectorized fixed guide vane stages 4,5,6 and 7 of the stator which are not fitted with a variable setting mechanism, and a plurality of corresponding rotor blade stages 13,14,15,16 and 17.

The downstream part 3 of the outer casing is constructed from two half-shells 30 and surrounds an inner casing formed by annular members 8,9,10,11 and 12, of which the four downstream members 9,10,11 and 12 carry the sectorized stages of fixed guide vanes 4,5,6 and 7 respectively.

Downstream from the final stage of rotor blades 17 is a diffuser 18 leading to a combustion chamber 40, and an annular housing 130 is formed within a casing surrounding the diffuser.

Figure 2:
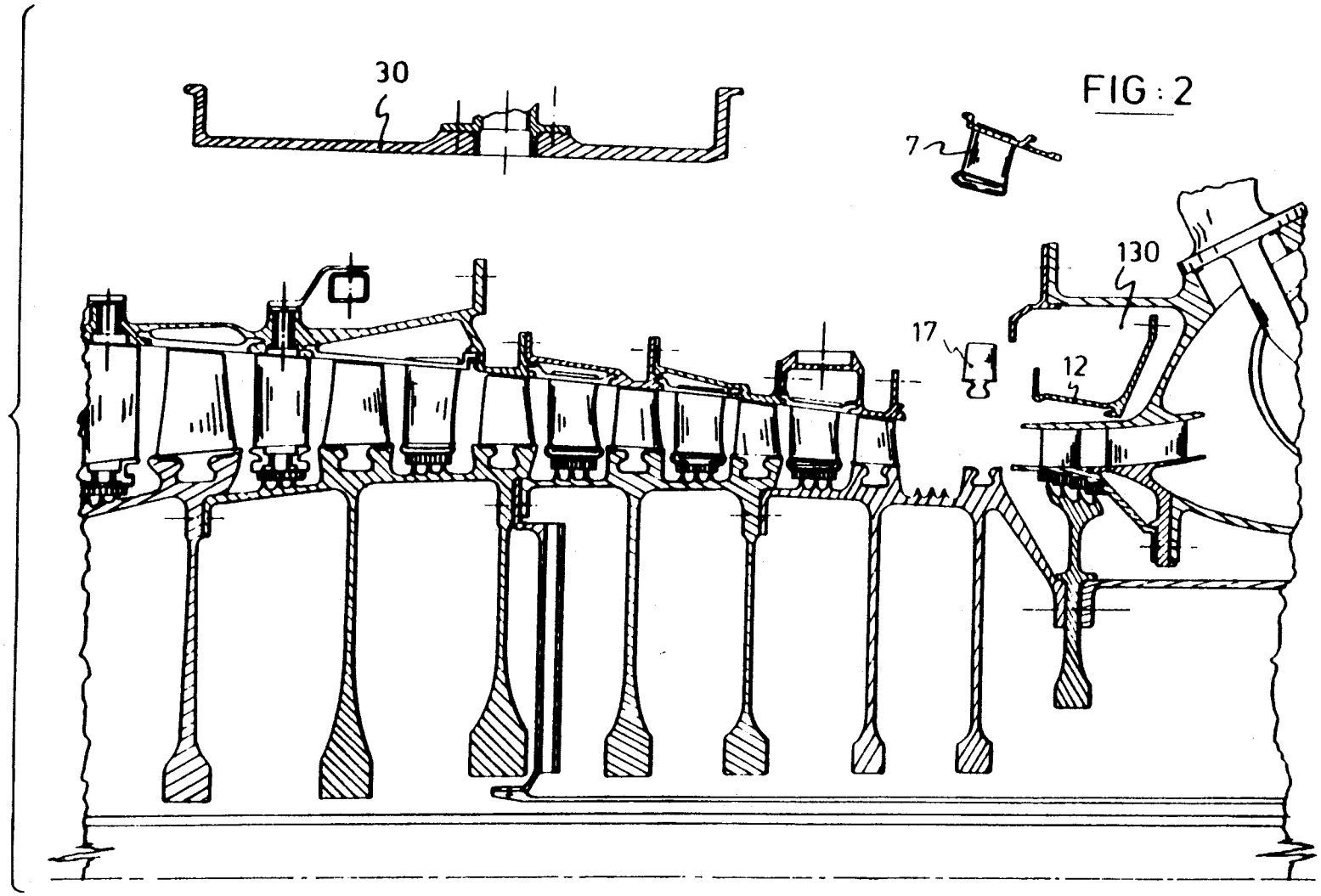
FIG. 2 is a view similar to FIG. 1 but showing the compressor after dismantling the downstream stage for maintenance operations.

The method of dismantling the fixed stator stages 4 to 7 and the corresponding rotor stages 13 to 17 of the HP compressor shown will now be described with reference to FIGS. 2 and 3.

Firstly the half shells 30 forming the downstream part 3 of the outer casing are removed, and the downstream annular member 12 of the inner casing is dismounted. The member 12 is then pushed downstream into the annular housing 130, and the sectors of fixed guide vanes forming the downstream stator stage 7 are removed as shown in FIG. 2. At this point it is possible to carry out inspection, repair and/or replacement as necessary of the movable blades 17 and the guide vanes 7 of the downstream rotor and stator stages respectively.

Following this, the next annular member 11 in the upstream direction is dismounted and temporarily connected to the member 12 in the housing 130, for example by bolts, thus freeing the sectors of fixed guide vanes forming the next stator stage 6 for removal to provide access to the movable blading of the rotor stage 16.

Figure 3:
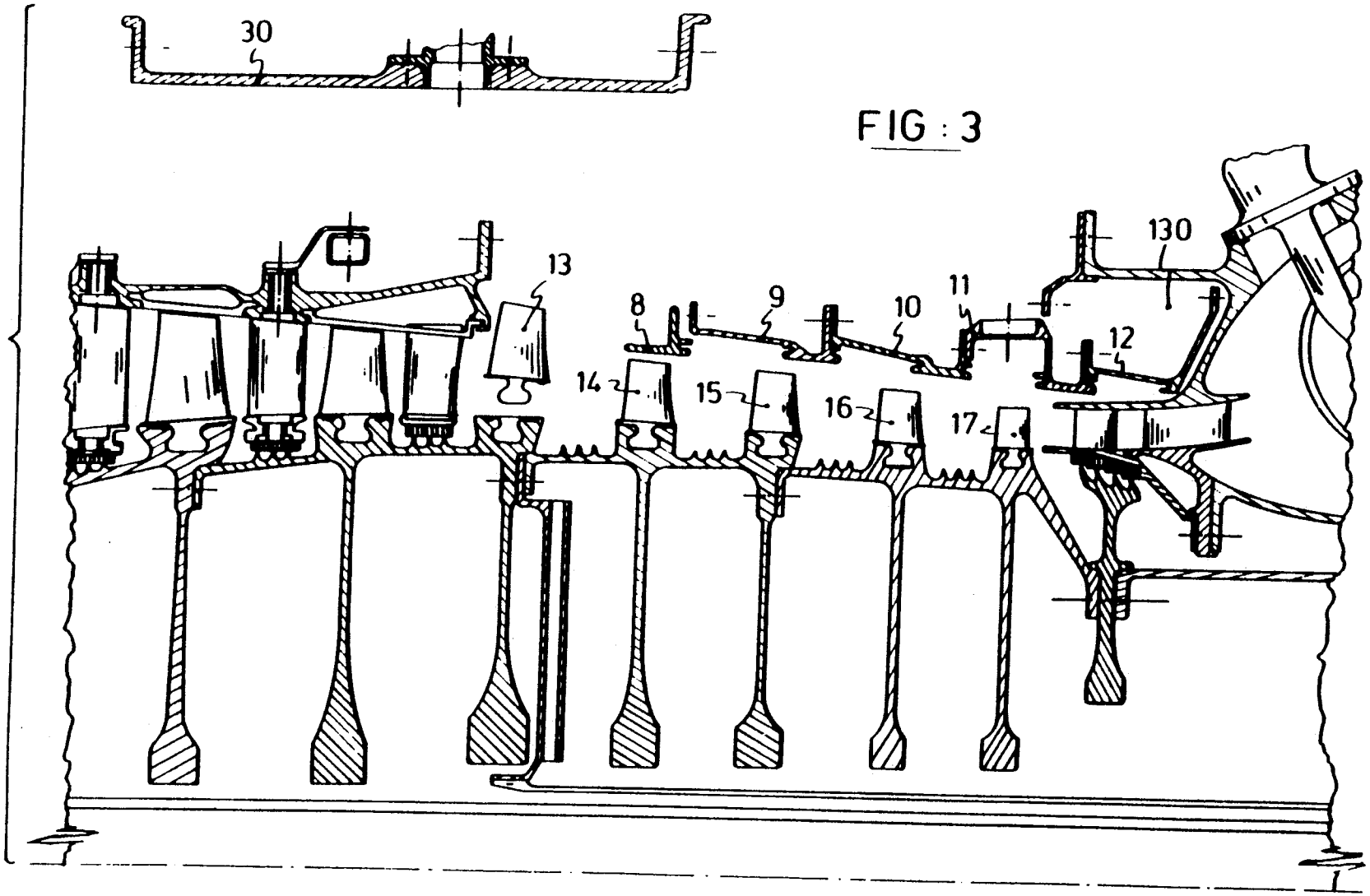
FIG. 3 is a view similar to FIGS. 1 and 2, but showing the compressor after dismantling all the stages back up to the upstream stages in the region of the variable guide vanes.

One then proceeds in the same way, dismounting the annular members 10,9 and 8 and the guide vanes of the stator stages 5 and 4 in succession working towards the upstream end, until access to the movable blading of the rotor stage 13 has been gained as shown in FIG. 3, each annular member being temporarily connected to the previously demounted member.

The design of the HP compressor in accordance with the invention imposes no particular outer shape on the outer casing 3, and the dismantling method is suited to any type of rotor, whether it is composed of integrally bladed wheels, otherwise termed an "all blisk" rotor, or whether it comprises blades individually mounted on the said rotor.

Among other advantages, the compressor and the maintenance procedure in accordance with the invention permit a not insignificant saving of time on maintenance, thus reducing the down-time of the engine of which it forms part, and the time of the aircraft on the ground.

We claim:

1. A maintenance-friendly axial compressor comprising a rotor and a stator, half-shells defining an outer casing, a plurality of annular members defining an inner casing within said outer casing, at least some of said annular members each carrying sectors of fixed guide vanes to define stages of said stator, movable blades carried by said rotor to define rotor stages alternating with said stator stages, and an annular housing downstream from said inner casing, said annular housing being capable of receiving an annular member corresponding to the downstream stage of said stator.

2. A compressor according to claim 1, comprising at its upstream end a stage of guide vanes provided with means for adjusting the setting of said vanes.

3. A method of servicing blades of an axial compressor having a rotor and a stator, half-shells defining an outer casing, a plurality of annular members defining an inner casing within said outer casing, at least some of said annular members each carrying sectors of fixed guide vanes to define stages of said stator, movable blades carried by said rotor to define rotor stages alternating with said stator stages, and an annular housing downstream from said inner casing, said annular housing receiving an annular member corresponding to the downstream stage of said stator, wherein said method comprises:

working from the downstream end of said compressor and includes the following steps:

a) removing said half shells forming said outer casing;

b) dismounting said annular member corresponding to said downstream stage of said stator;

c) pushing back said dismounted annular member into said annular casing;

d) removing said sectors fixed guide vanes forming said downstream stage of said stator;

e) inspecting and, as necessary, repairing or replacing said removed sectors of fixed guide vanes and said movable blades of the downstream stage of said rotor;

f) dismounting the next annular member in the upstream direction and temporarily securing it to the previously dismounted annular member;

g) removing said sectors of fixed guide vanes forming the next stage of said stator;

h) inspecting and, as necessary, repairing or replacing said removed sectors of fixed guide vanes of said next stator stage and said movable blades of the next rotor stage; and i) successively repeating steps (f) to (h) until access to the desired stage of said compressor is obtained.

* * * * *